US006209433B1

(12) United States Patent
Schiebout et al.

(10) Patent No.: US 6,209,433 B1
(45) Date of Patent: Apr. 3, 2001

(54) SINGLE REVOLUTION DIE CUTTER

(75) Inventors: David Schiebout, Blaine; Daniel Then, Shoreview; Timothy Howard, Coon Rapids, all of MN (US)

(73) Assignee: Delta Industrial Services, Inc., Coon Rapids, MN (US)

( * ) Notice: Subject to any disclaimer, the term of this patent is extended or adjusted under 35 U.S.C. 154(b) by 0 days.

(21) Appl. No.: 09/247,702

(22) Filed: Feb. 10, 1999

Related U.S. Application Data

(60) Provisional application No. 60/074,260, filed on Feb. 10, 1998.

(51) Int. Cl.[7] ..... B26D 7/06

(52) U.S. Cl. ..... 83/423; 83/430; 83/431; 83/663

(58) Field of Search ..... 83/426, 436.75, 83/436.9, 346, 423, 430, 431, 663

(56) References Cited

U.S. PATENT DOCUMENTS

| | | | | |
|---|---|---|---|---|
| 3,593,606 | * | 7/1971 | Raybuck | 83/423 |
| 3,899,945 | * | 8/1975 | Garrett et al. | 83/346 |
| 4,236,660 | * | 12/1980 | Kanemura | 226/95 |
| 4,455,903 | * | 6/1984 | Kesten | 83/346 |
| 4,553,461 | * | 11/1985 | Belongia | 83/346 |
| 4,625,612 | * | 12/1986 | Oliver | 83/346 |
| 5,001,950 | * | 3/1991 | Fokos et al. | 83/346 |
| 5,156,076 | * | 10/1992 | Rosemann | 83/346 |
| 5,174,185 | * | 12/1992 | Aichele | 83/346 |
| 5,189,935 | * | 3/1993 | Rosemann | 83/346 |
| 5,301,583 | * | 4/1994 | Kakko-Chiloff | 83/346 |
| 5,452,634 | * | 9/1995 | Wilson | 83/346 |
| 5,773,745 | * | 6/1998 | Widmer | 83/346 |
| 5,850,771 | * | 12/1998 | Killian | 83/423 |

* cited by examiner

*Primary Examiner*—S. Thomas Hughes
*Assistant Examiner*—Marc Jimenez
(74) *Attorney, Agent, or Firm*—Marvin L. Beekman; Skinner and Associates

(57) ABSTRACT

A rotary die cutter, comprising a frame, an anvil roll revolvably attached to the frame, a die roll revolvably attached to the frame and positioned in operable contact with the anvil roll, and a drive mechanism for revolving the anvil roll and the die roll. The apparatus further includes an engagement mechanism for selectively engaging and disengaging the drive mechanism from driving the anvil roll and the die roll. The engagement mechanism preferably includes a single revolution clutch that is released by energizing a solenoid. The invention further includes a method of die cutting product comprising the steps of turning a motor, feeding the product sheet between an anvil roll and a die roll and unlatching a clutch to engage the motor with the anvil roll and die roll.

22 Claims, 5 Drawing Sheets

SINGLE REVOLUTION DIE CUTTER

This application claims benefit of U.S. Provisional Ser. No. 60/074,260 filed Feb. 10, 1998.

BACKGROUND OF THE INVENTION

1. Field of the Invention

The present invention relates, generally, to rotary die cutting apparatus and methods, and further relates to apparatus and methods for cutting a product sheet. The invention has particular utility in cutting product sheets formed from thick stock such as multi-layer laminates, polymers, or polyurethanes. These product sheets include, but are not limited to, sports cards, school-type portraits, souvenirs and memorabilia.

2. Background Information

The state of the art includes various devices and methods for cutting a product sheet. These known devices are labor intensive. They are difficult to operate and maintain because of problems related to clearing jams and to replacing the tooling for product changeovers and wear.

The present invention provides an economical, durable, and simple apparatus and method for cutting product sheets which is believed to constitute an improvement over existing technology.

BRIEF SUMMARY OF THE INVENTION

The present invention provides an apparatus and method for cutting product sheets formed from thick stock. The apparatus or cutter generally comprises a frame, an anvil roll revolvably attached to the frame, a die roll revolvably attached to the frame and in operable contact with the anvil roll, and a drive mechanism for revolving the anvil roll and the die roll. Both the anvil roll and die roll have a cylindrical body. The anvil roll body has a smooth, hard surface. The die roll has tooling or blades that extend from the body. The anvil roll and die roll are geared together to allow product sheets to be fed between the rolls and cut by the tooling.

The frame generally comprises a base, a motor plate attached to the base, a set of opposing anvil bearing blocks attached to the base, and a set of opposing die bearing blocks attached to the anvil bearing blocks. The anvil roll extends between and is revolvably attached to the anvil bearing blocks. Similarly, the die roll extends between and is revolvably attached to the die bearing blocks. The die roll has a pair of spring-loaded pins that are retractable into the body of the die roll. The product sheet is fed into the apparatus and stopped by the pins in a predetermined position with respect to the tooling on the die roll. The pins are preferably rotatable and eccentric. An operator adjusts the predetermined position for stopping the product sheet by rotating the retractable pins.

The drive mechanism preferably comprises an electric motor. The motor drives the anvil roll using a belt. An engagement mechanism selectively engages the motor to the anvil roll, thus allowing the motor to run continuously. The engagement mechanism preferably includes a single revolution clutch attached to a journal shaft of the anvil roll. The clutch prevents the motor from driving the anvil roll when it is engaged, and allows the motor to drive the anvil roll for one revolution when it is released. The clutch is preferably actuated by energizing a solenoid. The engagement mechanism may further include a latch mechanism for accurately stopping the rotation of the clutch and the anvil roll after one revolution. The latch mechanism prevents backlash and provides a consistent stop and start position for each revolution, thus enabling the product sheets to be consistently and repeatably processed. The apparatus also includes a transparent upper cover around the die roll. The transparent cover enables the operator to monitor the die cutting process. Additionally, the upper cover and die bearing blocks are constructed and arranged to be quickly and easily removed, providing the operator with the ability to quickly remove and replace the die roll to sharpen the tooling or to perform a product changeover. Furthermore, the fasteners used to attach the die bearing blocks on the anvil bearing blocks provide a means to adjust the load pressure applied by the die roll against the anvil roll. The product sheet is fed along an infeed guide or product placement device into the cutter. Each sheet stops against the spring-loaded pins of the die roll, which is at a predetermined start and stop position. When the clutch is released, the revolving anvil roll and die roll draw the product sheet and cut the product into the desired pattern. The cut product exits into a tray. The product placement device eliminates guesswork by automatically centering the sheet to the tooling on the die roll.

The cutter is suitable for use in cutting product sheets of thick stock such as multi-layer laminates, polymers, or polyurethanes. For instance, the cutter can be used to cut sports cards or school portraits. For example, the apparatus can cut individual sports cards from an 8.5" by 7.5" sheet containing six cards in two rows and three columns. The cutter is designed to cut sheets ranging in width from 8½ inches to 17 inches.

The features, benefits and objects of this invention will become clear to those skilled in the art by reference to the following description, claims and drawings.

DETAILED DESCRIPTION

Figure 1:
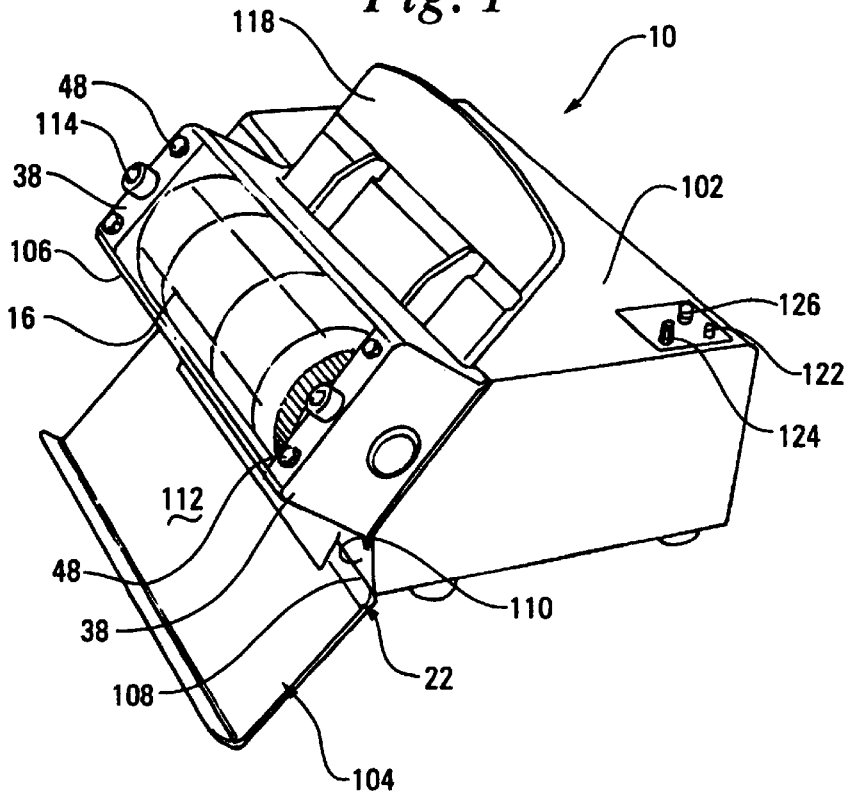
FIG. 1 is a perspective view of a the present invention.

Referring to FIG. 1, an example of the preferred embodiment of the present invention is illustrated and generally indicated by the reference numeral 10. The apparatus for cutting product sheets, or cutter 10, is described below first in terms of its major structural elements and then in terms of its secondary structural and/or functional elements which cooperate to cut product sheets.

Figure 5:
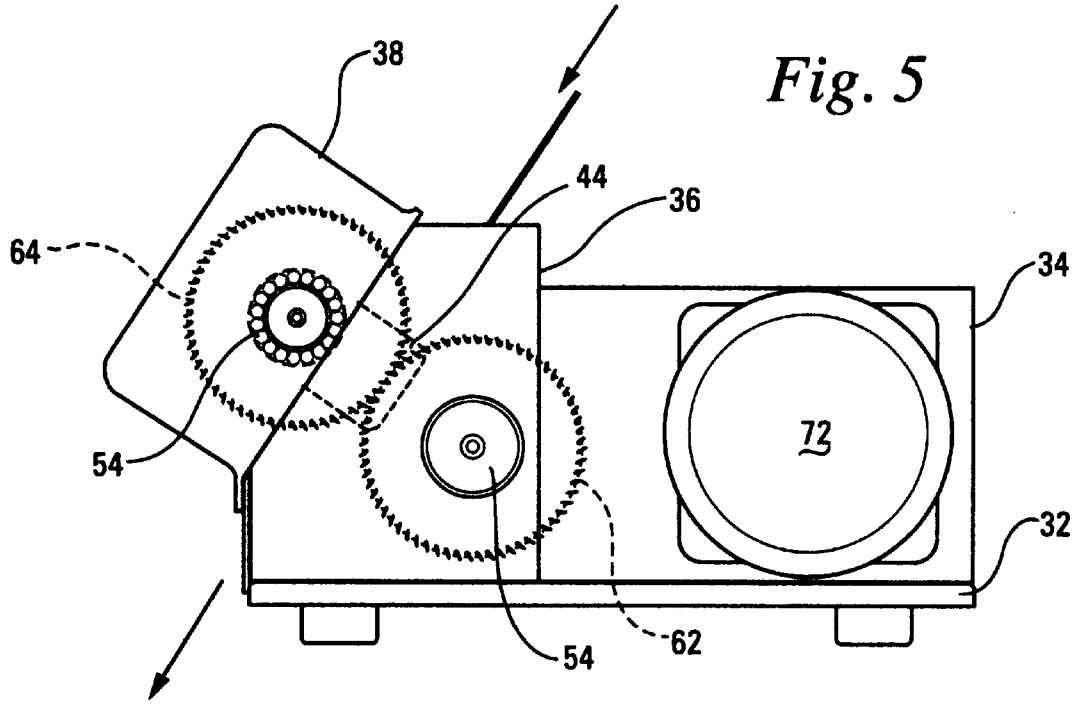
FIG. 5 is a side view of the present invention without the cover assembly.
Figure 6:
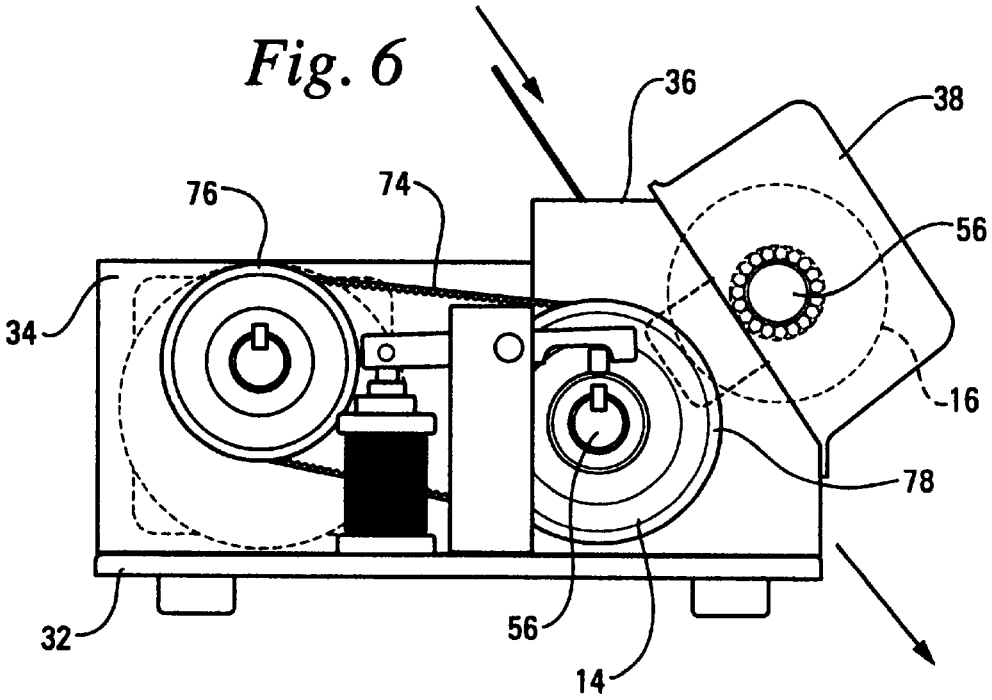
FIG. 6 is an opposite side view of the present invention without the cover assembly.
Figure 7:
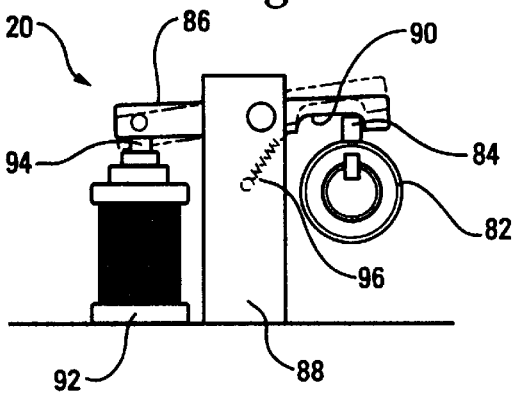
FIG. 7 is a side view of the engagement mechanism of the present invention.

Referring now to FIGS. 1, 3, 4 and 7, the cutter 10 generally comprises a frame 12, an anvil roll 14 revolvably attached to the frame 12, a die roll 16 revolvably attached to the frame 12 and in operable contact with the anvil roll 14, and a drive mechanism 18 for driving or revolving the anvil roll 14 and the die roll 16. As shown in FIG. 5, the product sheets are fed into the cutter 10 in between the anvil roll 14 and die roll 16 along the dotted line marked Product Path. The cylindrically-shaped body surfaces of the anvil roll 14 and die roll 16 press against each other and revolve to draw the product sheets between each other. The body surface of the die roll 16 has tooling, or blades, which cut the product sheets into a predetermined pattern. Additionally, as shown in FIGS. 2, 6 and 7, the cutter 10 includes an engagement mechanism 20 for selectively engaging and disengaging the drive mechanism 18 from driving or revolving the anvil roll 14 and die roll 16, and further includes a cover assembly 22 for promoting aesthetics, safety and durability.

The frame 12 generally comprises a base 32, a motor plate 34 attached to the base 32, a pair of opposing anvil bearing blocks 36 attached to the base 32, and a pair of opposing die bearing blocks 38 attached to the anvil bearing blocks 36. The base 32 is preferably a horizontally-oriented, plate-like structure that supports the other elements of the cutter 10. The motor plate 34 is preferably a vertically-oriented, plate-like structure that is fastened or otherwise attached to the base 32. The drive mechanism 18, particularly the motor 72, is mounted to the base 32 and motor plate 34. The anvil bearing blocks 36 are likewise fastened or otherwise attached to the base 32. Needle bearings 42 are pressed into journal openings in each of the anvil bearing blocks 36. Additionally, at least one of the anvil bearing blocks 36 has a window opening 44 through which an operator can view the alignment of the anvil roll 14, the die roll 16, and the product sheet in an assembled cutter 10. Each of the anvil bearing blocks 36 preferably has an inclined surface 46 upon which the die bearing blocks 38 are attached. The incline surface 46 allows the die roll 16 to be horizontally and vertically offset from the anvil roll 14, allowing the product sheets to be diagonally fed between the two rolls 14 and 16. This design simplifies the product input and output devices by utilizing gravitational force. Since the die roll 16 is replaced to sharpen the tooling and to perform product changeovers, it is desirable for an operator to quickly and easily remove and reattach the die bearing blocks 38. The preferred embodiment uses shoulder bolts 48, although other fasteners could be used, to quickly attach the die bearing blocks 38 to the anvil bearing blocks 36. These fasteners are tightened or loosened to adjust the load pressure between the die roll 16 and the anvil roll 14. The load pressure is preferably optimized to provide a quality cut in the product without undue wear on the tooling, and to prevent the product from walking to one side of the cutter 10 during the cutting process. Additionally, since it is desirable to accurately position the die roll 16 over the anvil roll 14, the bearing blocks 36 and 38 are preferably keyed together by mating at least one precision-machined aperture and precision-machined pin formed in the blocks 36 and 38. Needle bearings 42 are pressed into journal openings in each of the die bearing blocks 38.

Both the anvil roll 14 and die roll 16 comprise a generally cylindrically-shaped roll body 52, an idler journal shaft 54, and a drive journal shaft 56. The journal shafts 54 and 56 have a precision fit within the needle bearings 42 in the bearing blocks 36 and 38. The idler side of the anvil roll 14 has a gear 62 and the idler side of the die roll 16 has a gear 64. The anvil roll gear 62 and the die roll gear 64 mesh with each other to cause a revolving anvil roll 14 to drive or revolve the die roll 16 in the opposite direction. These gears 62 and 64 may be marked to allow an operator to view and synchronize or time the die roll 16, the anvil roll 14, and the product sheet. The die roll 16 has a pair of spring-loaded pins 66 that retract into the body 52 of the die roll 16 when they contact the surface of the anvil roll 14. These retractable pins 66 position the product sheet in a predetermined position with respect to the tooling on the die roll 16, and allow the product sheet to be drawn between the two rolls 14 and 16 in a controlled and precise manner. The pins 66 are preferably rotatable and eccentric, allowing an operator to adjust the placement of the product sheet by rotating the pins 66. Additionally, the pins 66 may have graduated markings to enable an operator to rotate each pin 66 the same amount to prevent the product sheets from skewing as they are fed into the cutter 10.

Figure 2:
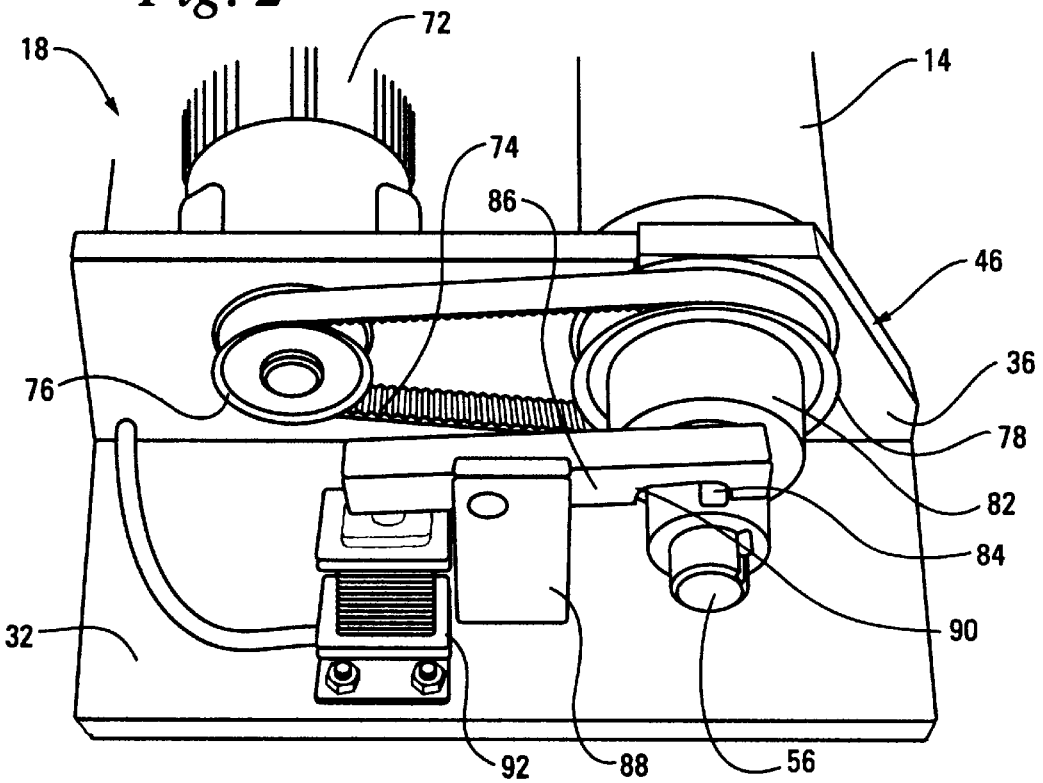
FIG. 2 is a perspective view of the drive mechanism and engagement mechanism of the present invention.
Figure 3:
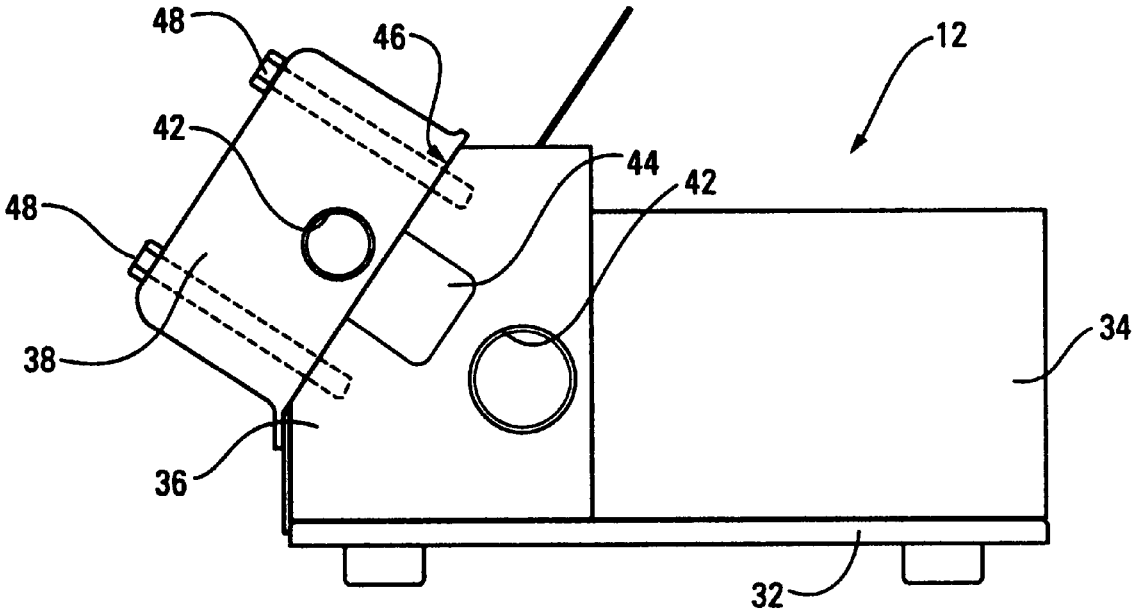
FIG. 3 is a side view of the frame of the present invention.
Figure 4:
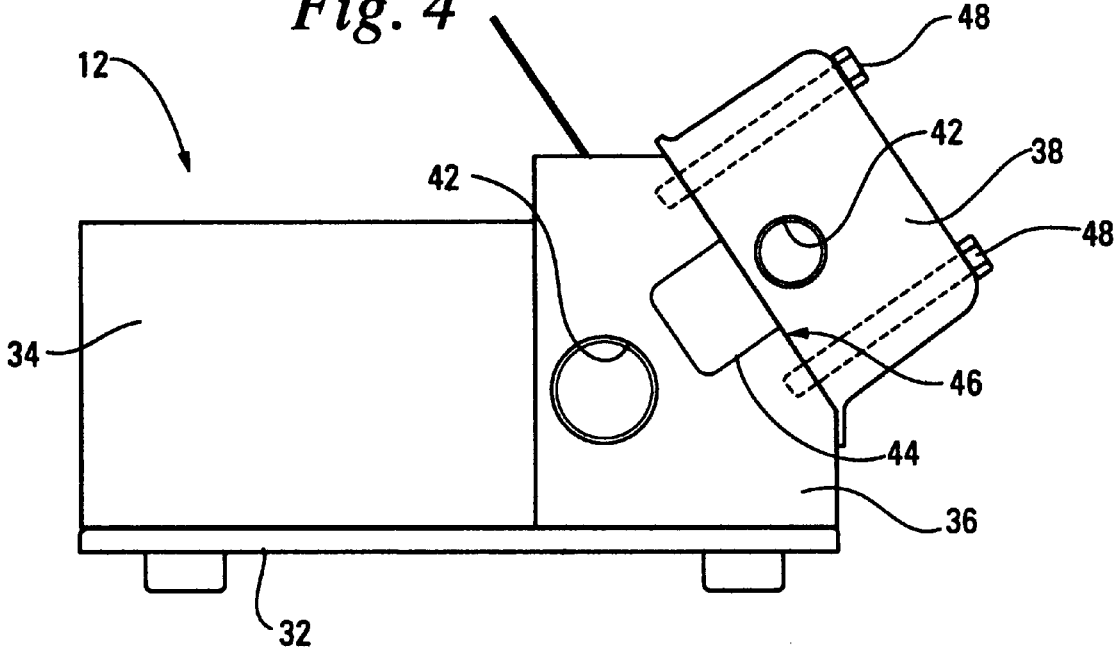
FIG. 4 is an opposite side view of the frame of the present invention.
Figure 8:
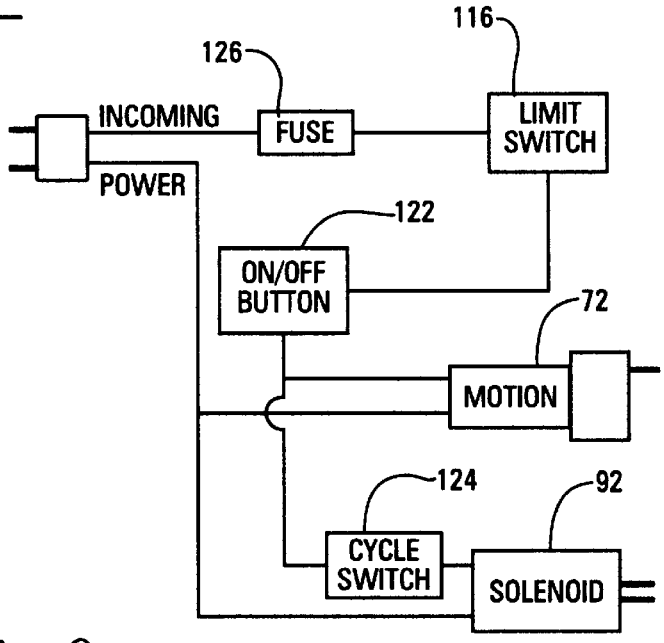
FIG. 8 is an electrical schematic of the present invention.

Referring to FIGS. 2 and 7, the drive mechanism 18 preferably comprises a motor 72. The motor 72 drives the anvil roll 14 through a timing belt 74 that extends between a motor pulley 76 attached to the motor 72 and a clutch pulley 78 that is attached to the drive journal shaft 56 of the anvil roll 14. The motor 72 is preferably a fractional horsepower, AC electric motor that, as shown in FIG. 8, operates on common line voltage.

Figure 9:
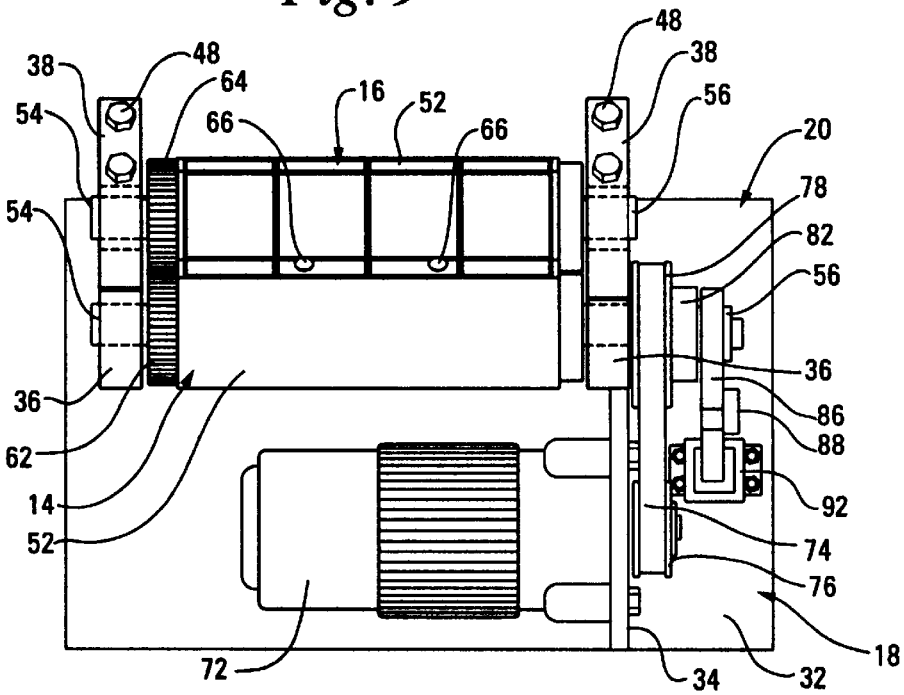
FIG. 9 is a top view of the present invention without the cover assembly.
Figure 10:
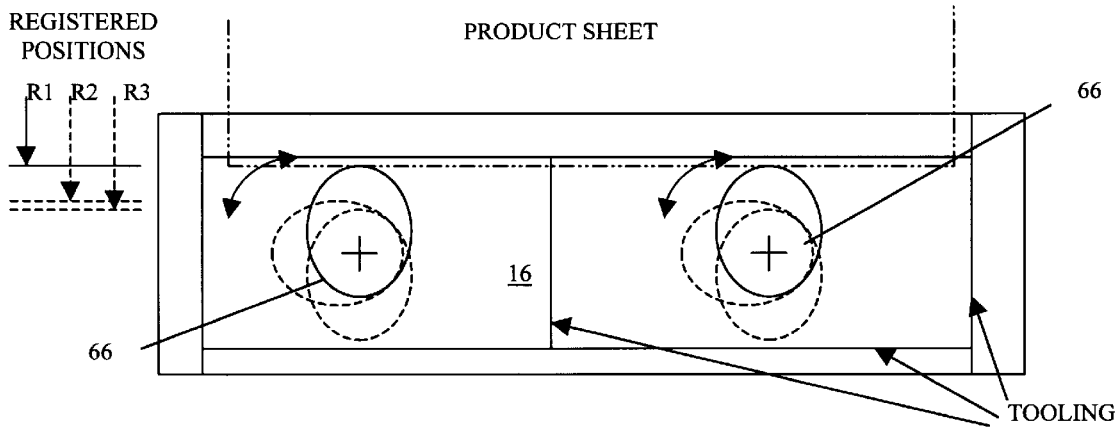
FIG. 10 is illustrates the rotatable eccentric pins in a die roll, and the product placement against these rotatable eccentric pins in a predetermined location with respect to the tooling in the die roll.
Figure 11A:
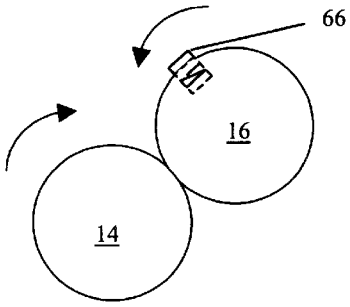
FIGS. 11*a,* 11*b* and 11*c* illustrate the eccentric pins retracting into the cylindrical body of the die roll.
Figure 11B:
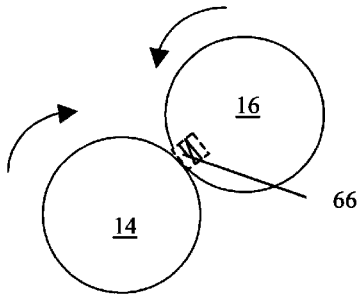
Figure 11C:
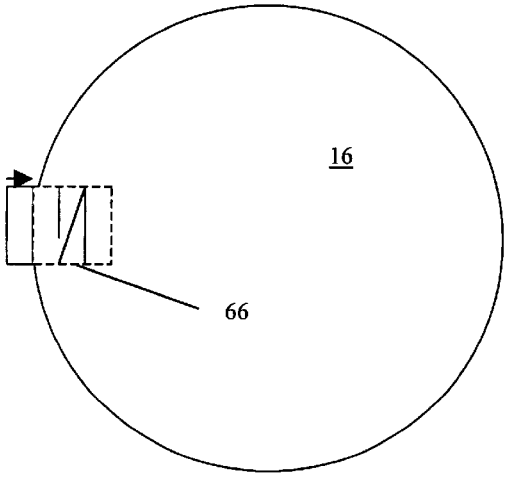

The engagement mechanism 20 selectively engages the motor 72 to the anvil roll 14, thus allowing the motor 72 to run continuously. Referring to FIGS. 2, 7 and 9, the engagement mechanism 20 preferably includes a single revolution clutch 82 attached to the drive journal shaft 56 of the anvil roll 14 and to the clutch pulley 78. The clutch 82 prevents the motor 72 from driving the anvil roll 14 when the clutch 82 is engaged or latched, and allows the motor 72 to drive the anvil roll 14 one revolution when the clutch 82 is actuated or released. The clutch 82 has a tine 84 that extends from an exterior surface. When the clutch 82 is engaged, the tine 84 on the clutch and the anvil roll 14 remain stationary. When the clutch 82 is released, the tine 84 on the clutch and the anvil roll 14 revolve. The engagement mechanism 20 also includes a clutch release arm 86 that pivots on an arm stand 88 to move between a clutch release position and an engage position. The arm 86 has a notch 90 on a proximal end which latches with the tine 84 of the clutch 82 when the arm 86 is in the engage position. The clutch 82 is preferably actuated by energizing a solenoid 92. Alternatively, the clutch 82 could be mechanically actuated with a plunger. In the embodiment shown in FIGS. 2, 6, 7 and 9, the solenoid 92 is attached by a link 94 to the distal end of the arm 86. The energized or actuated solenoid 92 pulls down on the distal end of the arm 86, causing the arm 86 to pivot into the release position by raising the proximal end of the arm 86 and by unlatching the notch 90 from the tine 84. The arm 86 is preferably biased in the engage position with a bias spring 96 that extends between the proximal end of the arm 86 and the stand 88.

The engagement mechanism 20 may further include a latch mechanism, not shown in the figures, for preventing backlash and for consistently and accurately stopping the clutch, the anvil roll and the die roll from revolving after each revolution. The latch mechanism stops the revolving clutch and the anvil roll at a predetermined start and stop point with a predetermined accuracy. An operator can quickly, repeatably and accurately process successive product sheets because the start and stop position of the clutch and anvil roll are known and are accurately controlled. After each revolution, the operator merely places the product sheet on the pins 66 of the die roll 16 to position the product sheet in a desired predetermined position with respect to the tooling on the die roll 16. The operator then releases the clutch 82 to engage the motor 72 and process the product sheet.

The cover assembly 22 generally includes a rear cover 102, a front cover 104, and an upper cover 106. The rear cover 102 is attached to the base 32 and generally covers the drive mechanism 18, the engagement mechanism 20, and the anvil roll 14. The front cover 104 is preferably mounted to the base 32 at a generally vertical mount portion 108. The front cover 104 also includes an inclined upper portion 110 that extends toward the intersection of the anvil roll 14 and die roll 16, and further includes an inclined lower tray portion 112 that receives the cut or processed product below the die roll 16. A scraper blade may be attached to the upper portion 110 to remove any cut product that may cling to the surface of the anvil roll 14. The upper cover 106 generally covers the die roll 16. It is preferably transparent or clear to enable the operator to monitor the die cutting process. The upper cover 106 is preferably attached to the die bearing blocks 38 using knurled screws 114. These screws 114 allow an operator to quickly access and remove the die roll 16. A limit switch 116 is wired into the electrical circuit to prevent the cutter 10 from operating with the upper cover 106 removed. A product placement device or infeed tray 118 may be mounted onto the anvil bearing blocks 36 to properly feed the product sheet between the rolls 14 and 16. The infeed tray 118 shown in the figures auto centers the product sheet with respect to the tooling on the die roll 16.

The cutter 10 utilizes an operator interface with few controls, thus simplifying the process of cutting product sheets. The controls of the cutter 10 include a lighted power switch 122 and a cycle switch 124. The power switch provides current to the electric motor 72. However, the engaged clutch 82 prevents the anvil roll 14 and the die roll 16 from revolving. The cycle switch 124 energizes the solenoid 92, which temporarily releases the clutch 82 allowing the anvil roll 14 to rotate for one revolution. The cycle switch 124 may take a variety of forms, including a finger actuated switch as shown in the figures or a foot-actuated switch. Referring to FIGS. 1 and 8, the cutter 10 operates on common line voltage and is wired with an easily replaceable fuse 126.

An operator performs the following steps to cut photographic prints. First, the operator turns on the motor by pressing the power switch. The motor may run continuously through the process. Second, the operator sets a product sheet in an infeed tray to feed the product sheet between the anvil roll and the die roll of the cutter. The product sheet rests on the eccentric, spring-loaded retractable pins on the die roll. These pins may be rotated to adjust the position of the edge of the product sheet with respect to the tooling on the die roll. Third, the operator actuates the cycle switch to engage the motor and revolve the anvil roll and the die roll. The cycle switch moves a clutch release arm into a release position and unlatches or releases the clutch. The product is drawn between the rolls and cut by the tooling on the die.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. An apparatus adapted for cutting product sheets, comprising:

(a) a frame;

(b) an anvil roll revolvably attached to said frame, said anvil roll having a cylindrical body;

(c) a die roll revolvably attached to said frame, said die roll having a cylindrical body in operable contact with said cylindrical body of said anvil roll said die roll being equipped with tooling constructed and arranged to cut product sheets, each of said product sheets being fed between said anvil roll and said die roll, said die roll being equipped with at least one spring-loaded pin, said at least one pin retracting into said cylindrical body of said die roll, said at least one pin stopping each of said product sheets in a predetermined location with respect to said tooling to register each of said product sheets to be properly cut by said tooling; and (d) a drive mechanism for revolving said anvil roll and said die roll.

2. The apparatus of claim 1, wherein said frame further comprises a base plate attached to a motor plate, said drive mechanism being mounted on said base plate and to said motor plate.

3. The apparatus of claim 1, wherein said frame further comprises a pair of opposing anvil bearing blocks attached to a base plate, said anvil roll having a first end and a second end, said anvil roll extending between said anvil bearing blocks, each of said ends of said anvil roll being revolvably attached to one of said anvil bearing blocks.

4. The apparatus of claim 3, wherein said frame further comprises a pair of opposing die bearing blocks attached to said pair of anvil bearing blocks, said die roll having a first end and a second end, said die roll extending between said die bearing blocks, each of said ends of said die roll being revolvably attached to one of said die bearing blocks.

5. The apparatus of claim 4, wherein said anvil bearing blocks has an inclined surface, said pair of die bearing blocks being constructed and arranged to be quickly detached from and reattached to said inclined surface of said pair of anvil bearing blocks using fasteners.

6. The apparatus of claim 1, wherein said anvil roll has a gear and said die roll has a gear, said anvil roll gear meshing with said die roll gear.

7. The apparatus of claim 6, wherein said drive mechanism is connected to said anvil roll, said drive mechanism driving said anvil roll in a predetermined rotational direction, said anvil roll driving said die roll in an opposite rotational direction.

8. The apparatus of claim 7, wherein a portion of said meshing gears in an assembled apparatus are visible to an operator, the operator being capable of viewing the alignment of said die roll gear with said anvil roll gear and the placement of product between said anvil roll and said die roll.

9. The apparatus of claim 1, wherein said at least one pin is rotatable and eccentric, wherein said predetermined location for stopping each of said product sheets with respect to said tooling to register each of said product sheets to be properly cut by said tooling is adjustable by rotating said at least one eccentric pin.

10. The apparatus of claim 1, wherein said drive mechanism is an electrical motor.

11. The apparatus of claim 1, further comprising an engagement mechanism for selectively engaging and disengaging said drive mechanism from driving said anvil roll and said die roll.

12. The apparatus of claim 11, wherein said engagement mechanism includes a clutch attached to said anvil roll.

13. The apparatus of claim 12, wherein said clutch is a single revolution clutch, said clutch being constructed and arranged to have a released state in which said drive mechanism drives said anvil roll one revolution and an engaged state wherein said drive mechanism does not drive said anvil roll.

14. The apparatus of claim 13, wherein said engagement mechanism further includes a clutch release arm, said arm being movable between a release position and an engage position, said clutch having an exterior surface and a tine extending out from said cylindrical surface, said clutch release arm having a notch, said tine of said clutch latching with said notch of said arm when said arm is in said engage position, said tine of said clutch being released from said notch of said arm when said arm is in said release position.

15. The apparatus of claim 14, wherein said arm is biased in said engage position.

16. The apparatus of claim 14, wherein said engagement mechanism further includes an actuator for moving said arm.

17. The apparatus of claim 16, wherein said actuator is a solenoid having an energized state, said solenoid moving said arm from said engage position to said release position when energized.

18. The apparatus of claim 12, wherein said engagement mechanism further includes a latch mechanism for accurately stopping said clutch and said anvil roll from revolving at a predetermined start and stop position.

19. The apparatus of claim 1, further including a cover assembly, said cover assembly including a transparent upper cover around said die roll.

20. The apparatus of claim 1, further including a product placement device for operably feeding product between said die roll and said anvil roll, and a tray for receiving processed product.

21. A rotary die cutter adapted for cutting out images from product sheets, comprising:

(a) a frame;

(b) an anvil roll revolvably attached to said frame, said anvil roll having a cylindrical body;

(c) a die roll revolvably attached to said frame, said die roll having a cylindrical body in operable contact with said cylindrical body of said anvil roll, said die roll being equipped with tooling constructed and arranged to cut out images from said product sheets, each of said product sheets being fed between said anvil roll and said die roll, said die roll being equipped with at least one spring-loaded pin, said at least one pin retracting into said cylindrical body of said die roll, said at least one pin stopping each of said product sheets in a predetermined location with respect to said tooling to register each of said product sheets to be properly cut by said tooling;

(d) a drive mechanism for revolving said anvil roll and said die roll; and (e) an engagement mechanism for selectively engaging and disengaging said drive mechanism from driving said anvil roll and said die roll, said engagement mechanism including a single revolution clutch attached to said anvil roll.

22. A single revolution rotary die cutter, comprising:

(a) a frame including a pair of opposing anvil bearing blocks attached to a base plate and a pair of opposing die bearing blocks attached to said pair of anvil bearing blocks, said pair of die bearing blocks being constructed and arranged to be quickly detached from and reattached to said pair of anvil bearing blocks;

(b) an anvil roll extending between said pair of anvil bearing blocks, said anvil roll having a cylindrical body, said anvil roll having a first end and a second end, each of said ends of said anvil roll being revolvably attached to one of said anvil bearing blocks;

(c) a die roll extending between said pair of die bearing blocks, said die roll having a cylindrical body in operable contact with said cylindrical body of said anvil roll, said die roll having a first end and a second end, each of said ends of said die roll being revolvably attached to one of said die bearing blocks, said die roll being equipped with:

(i) tooling constructed and arranged to cut product sheets fed between said anvil roll and said die roll; and (ii) at least one spring-loaded pin, said at least one pin retracting into said body of said die roll when contacting said anvil roll, said at least one pin stopping each of said product sheets in a predetermined location with respect to said tooling to register each of said product sheets to be properly cut by said tooling, said at least one pin being rotatable and eccentric, wherein said predetermined location for stopping each of said product sheets with respect to said tooling is adjustable by rotating said at least one eccentric pin;

(d) an electric motor for driving said anvil roll and said die roll; and (e) an engagement mechanism for selectively engaging and disengaging said drive mechanism from driving said anvil roll and said die roll, said engagement mechanism including:

(i) a single revolution clutch attached to said anvil roll, said clutch having a released state and an engaged state, said drive mechanism driving said anvil roll one revolution when said clutch is in said released state, said clutch having an exterior surface and a tine extending out from said cylindrical surface;

(ii) a clutch release arm movable between a release position and an engage position, said arm having a notch, wherein said tine is latched with said notch when said arm is in said engage position and said tine is released from said notch of said arm when said arm is in said release position, said arm being biased in said engage position; and (iii) a solenoid for moving said arm from said engage position to said release position when energized.

* * * * *